US006979289B2

(12) United States Patent
McMahon et al.

(10) Patent No.: US 6,979,289 B2
(45) **Date of Patent: *Dec. 27, 2005**

(54) INSERTION APPARATUS FOR ATTACHING SLIDERS ONTO ZIPPER BAGS AND FILM

(75) Inventors: Michael McMahon, Palatine, IL (US); Stanley Piotrowski, Schiller Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/658,305

(22) Filed: Sep. 9, 2003

(65) Prior Publication Data

US 2004/0045141 A1 Mar. 11, 2004

Related U.S. Application Data

(62) Division of application No. 10/096,409, filed on Mar. 11, 2002.

(51) Int. Cl.[7] ..... B31B 1/84

(52) U.S. Cl. ..... 493/213; 493/114; 493/214; 493/927

(58) Field of Search ..... 493/213, 114, 121, 493/214, 325, 394, 927

(56) References Cited

U.S. PATENT DOCUMENTS

| | | | | |
|---|---|---|---|---|
| 3,172,443 | A | 3/1965 | Ausnit | 150/3 |
| 3,203,062 | A | 8/1965 | Ausnit | 24/201 |
| 3,220,076 | A | 11/1965 | Ausnit et al. | 24/201 |
| 3,226,787 | A | 1/1966 | Ausnit | 24/201 |
| 3,347,298 | A | 10/1967 | Ausnit et al. | 150/3 |
| 3,426,396 | A | 2/1969 | Laguerre | 24/201 |
| 3,430,329 | A | 3/1969 | Ausnit | 29/408 |
| 3,701,191 | A | 10/1972 | Laguerre | 29/207 |
| 3,701,192 | A | 10/1972 | Laguerre | 29/207 |
| 3,713,923 | A | 1/1973 | Laguerre | 156/66 |
| 3,780,781 | A | 12/1973 | Uramoto | 150/3 |
| 4,199,845 | A | 4/1980 | Ausnit | 24/201 |
| 4,581,006 | A | 4/1986 | Hugues et al. | 493/213 |
| 4,620,320 | A | 10/1986 | Sullivan | 383/79 |
| 4,736,451 | A | 4/1988 | Ausnit | 383/65 |
| 4,894,975 | A | 1/1990 | Ausnit | 53/412 |
| 5,007,142 | A | 4/1991 | Herrington | 24/400 |
| 5,007,143 | A | 4/1991 | Herrington | 24/400 |
| 5,010,627 | A | 4/1991 | Herrington et al. | 24/400 |
| 5,020,194 | A | 6/1991 | Herrington et al. | 24/400 |
| RE33,674 | E | 8/1991 | Uramoto | 206/620 |
| 5,063,644 | A | 11/1991 | Herrington et al. | 24/400 |
| 5,067,208 | A | 11/1991 | Herrington, Jr. et al. | 24/400 |

(Continued)

*Primary Examiner*—Louis K. Huynh
*Assistant Examiner*—Sameh H. Tawfik
(74) *Attorney, Agent, or Firm*—Pitney Hardin LLP

(57) ABSTRACT

A slider (10), a slider insertion apparatus (50) and a method for inserting the slider (10) on an interlocked fastener or zipper (25) of a reclosable bag (44). A loading rack (58, 72) feeds individual sliders (10) to the slider insertion apparatus (50) wherein the slider (10) is inserted on the interlocked profiles (24, 28) being held by a zipper guide (56). After insertion, a keeper (15) and retaining shoulders (19, 20) of the slider (10) secure an interlocking member (22) of the profile (24) from unintentional engagement with an interlocking member (26) of the opposing profile (28). A positioner (200) is used to move the inserted slider (10) and/or to move the attached reclosable bag (44) in conjunction with driving rollers (217) of a vertical form-fill-and-seal machine.

11 Claims, 12 Drawing Sheets

U.S. PATENT DOCUMENTS

| | | | | |
|---|---|---|---|---|
| 5,070,583 | A | 12/1991 | Herrington | 24/400 |
| 5,088,971 | A | 2/1992 | Herrington | 493/203 |
| 5,189,764 | A | 3/1993 | Herrington et al. | 24/387 |
| 5,283,932 | A | 2/1994 | Richardson et al. | 24/400 |
| RE34,554 | E | 3/1994 | Ausnit | 383/63 |
| 5,301,395 | A | 4/1994 | Richardson et al. | 24/400 |
| 5,383,989 | A | 1/1995 | McMahon | 156/66 |
| 5,405,478 | A | 4/1995 | Richardson et al. | 156/308 |
| 5,426,830 | A | 6/1995 | Richardson et al. | 24/430 |
| 5,431,760 | A | 7/1995 | Donovan | 156/66 |
| 5,442,837 | A | 8/1995 | Morgan | 24/400 |
| 5,442,838 | A | 8/1995 | Richardson et al. | 24/402 |
| 5,482,375 | A | 1/1996 | Richardson et al. | 383/64 |
| 5,561,966 | A | 10/1996 | English | 53/412 |
| 5,664,299 | A | 9/1997 | Porchia et al. | 24/400 |
| 5,713,669 | A | 2/1998 | Thomas et al. | 383/204 |
| 5,956,924 | A | 9/1999 | Thieman | 53/412 |
| 5,964,532 | A | 10/1999 | St. Phillips et al. | 383/5 |
| 6,138,439 | A | 10/2000 | McMahon | 53/412 |
| 6,178,722 | B1 | 1/2001 | McMahon | 53/412 |
| 6,796,015 | B2 * | 9/2004 | Cortigiano, Sr. | 29/410 |
| 6,842,973 | B2 * | 1/2005 | Share et al. | 29/768 |

* cited by examiner

INSERTION APPARATUS FOR ATTACHING SLIDERS ONTO ZIPPER BAGS AND FILM

This application is DIV of U.S. patent application Ser. No. 10/096,409, filed on Mar. 11, 2002.

FIELD OF THE INVENTION

The present invention relates to reclosable plastic bags having slide zippers and, more particularly, to a slider, a slider insertion apparatus, a method for inserting the slider on an interlocked zipper, and a device for positioning the inserted and straddling slider on the interlocked zipper.

DESCRIPTION OF THE PRIOR ART

Reclosable bags having slide zippers are generally more desirable to consumers than bags which have traditional interlocking zippers, since such bags are perceived to be easier to open and close than slider-less zippers. As a result, slide zippers for use with plastic bags are numerous and well known in the reclosable fastener art. Typical slide zippers comprise a plastic zipper having two interlocking profiles and a slider for engaging and disengaging the interlocking profiles of the zipper. The slider straddles the zipper and has a separator at one end which inserts between the profiles to force them apart; that is, the separator plows between the interlocking members of the profiles forcing them to disengage and open the zipper. The other end of the slider is sufficiently narrow to be able to close the zipper by forcing the interlocking members of the profiles to re-engage. Examples of conventional slide zippers can be found in U.S. Pat. Nos. 3,426,396; 3,713,923; 5,007,143; 5,088,971; 5,131,121 and 5,664,299.

Methods and apparatuses for manufacturing reclosable plastic bags using reclosable zippers with a slider are also well known in the art. Known slider loaders include the Hugues reference (U.K. Patent No. 2,085,519) and the LaGuerve references (U.S. Pat. Nos. 3,701,191 and 3,701,192). Use of these prior art apparatuses is limited by requiring a separation of the interlocked members of profiles prior to the insertion of a slider. By requiring this separation of the interlocked members, slider insertion in manufacturing reclosable bags requires an extra step as well as a potential for machine breakdown associated with this extra step.

An improved slider for zipper assemblies has been developed in Machacek et al (U.S. Pat. No. 6,047,450). The slider of the Machacek patent includes features that facilitate the insertion of a slider onto the zipper of a reclosable bag. Most importantly, the Machacek patent allows the slider to be inserted over a closed zipper without the requirement of first separating the interlocking members of the zipper.

Despite the advantages of the Machacek patent, technical advances allow further improvement to the slider described in Machacek. An improvement would allow the slider to be inserted with the zipper fully secured in the slider, so that during an opening of the reclosable bag the interlocking members of the profiles of the zipper would not unintentionally re-engage within the slider.

For example, a re-engagement of the interlocking members could occur when the zipper opening end of the slider is pushed toward a closed zipper park position. Such a re-engagement can occur during operation of the zipper or if the slider is inserted too far from an end stomp of the zipper. By reducing the possibility of unintentional re-engagement of the interlocking members of the profiles, production of defective bags is reduced.

Since the Machacek patent eliminates the requirement of separating the interlocking members of the zipper of a reclosable bag prior to insertion of a slider, this eliminated requirement permits the use of a smaller sized slider insertion apparatus. The slider insertion apparatus would also have the advantage of bringing the entry of stored sliders as close as possible to an inserting position, with the result of minimizing manufacturing time or maintenance requirements.

Once the slider is inserted on the interlocking members of the zipper, a relatively simple and effective pneumatic device for positioning the straddling slider to open or to close the reclosable bag is also desirable. Along with the portability of pneumatic sources, a pneumatic positioner would have the advantage of being able to be used at various points in the bag manufacturing process. In a vertical form-fill-and-seal machine, the positioner could assist in movement of the reclosable bag within the machine.

SUMMARY OF THE INVENTION

Accordingly, the present invention provides an improved slider for securing interlocking members of the zipper and a slider insertion apparatus. The slider insertion apparatus includes an activator with pusher, an insertion cylinder, and a zipper guide. The zipper guide and the activator with pusher are manufactured to facilitate movement of the zipper within the slider insertion apparatus; to properly position the profiles of the zipper for slider insertion; and to secure the zipper when the slider is inserted onto the zipper. A loading rack with a supply of sliders may be part of the slider insertion apparatus, with the loading rack being a mechanically attachable device.

In the slider insertion process, a fastener or a zipper with its profiles interlocked by their interlocking members is guided between opposing male and female guide plates of the zipper guide. The zipper is further guided to an insertion point under the activator with pusher. The activating fork of the activator with pusher secures and offsets the interlocking members to accommodate a slider. The slider is inserted onto the interlocked zipper by the pusher area of the activator with pusher.

After insertion of the slider onto the zipper of the reclosable bag, a positioner fluidly attached to a pneumatic supply may be used for positioning the straddling slider on the zipper. When the positioner is used in conjunction with the driving rollers of a vertical form-fill-and-seal (VFFS) machine, the positioner assists in moving the zippered film within the machine.

BRIEF DESCRIPTION OF THE DRAWINGS

Thus by the present invention its objects and advantages will become readily apparent upon reading the following detailed description in conjunction with the accompanying drawings, in which.

DETAILED DESCRIPTION OF THE PREFERRED EMBODIMENT

Figure 1:
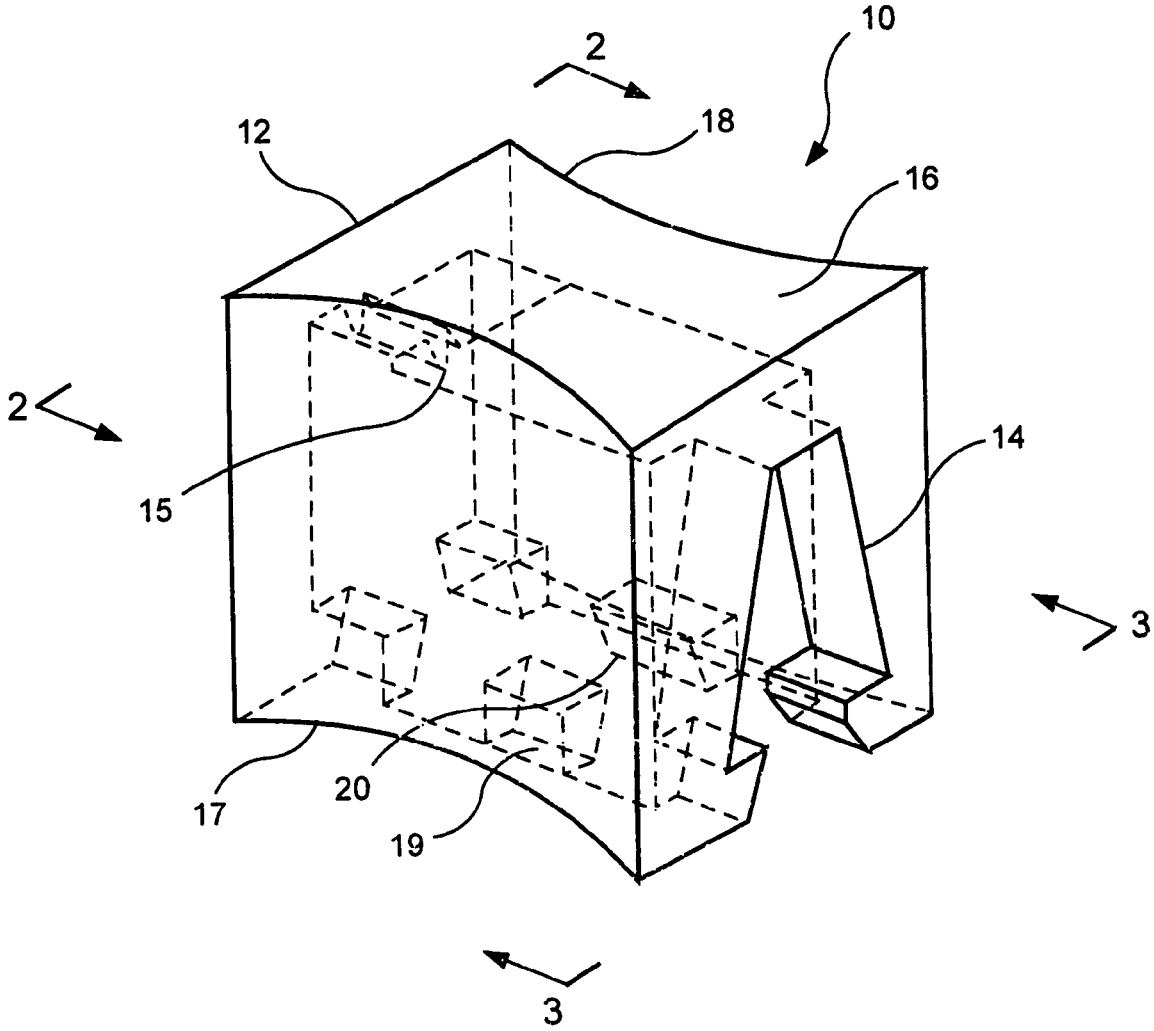
FIG. 1 is a perspective view depicting a slider of the present invention.

Referring now to the drawings in detail wherein like numerals indicate like elements throughout the several views, FIG. 1 is a perspective view of an improved slider 10 of the present invention. As shown in the figure, the slider 10 includes a zipper opening end 12 and a zipper closing end 14.

The slider 10 further includes a keeper 15 extending from a top plane 16 of the slider 10 between arms 17 and 18 toward longitudinally extending retaining shoulders 19 and 20. The retaining shoulders 19 and 20 are shown as discontinuous; however, the shoulders may be continuous along the length of the slider 10. The keeper 15 as well as the retaining shoulders 19 and 20 secure a zipper within the slider 10, as shown in FIG. 2.

Figure 2:
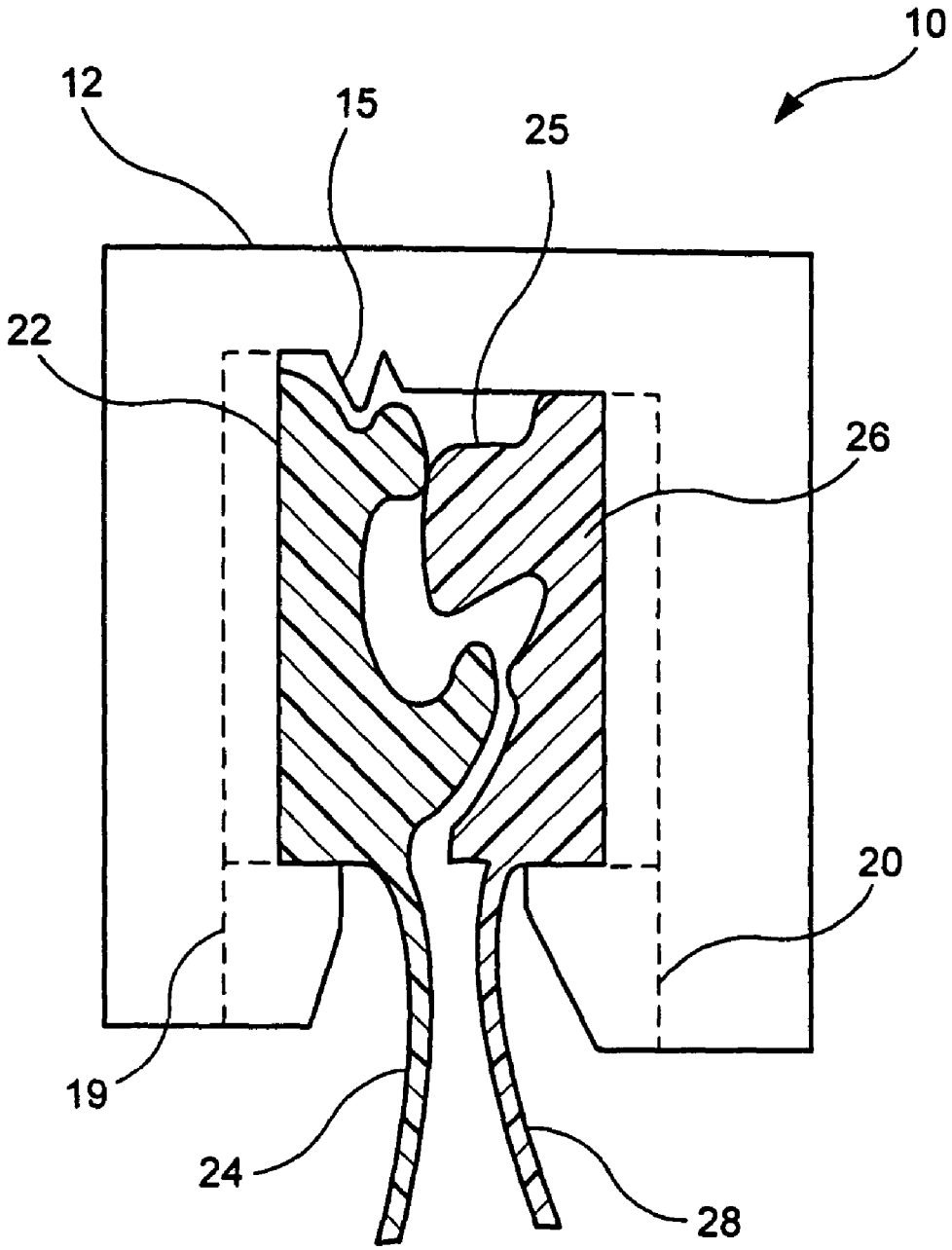
FIG. 2 is an end view of the zipper opening end of the slider with the slider shown encompassing a zipper.
Figure 3:
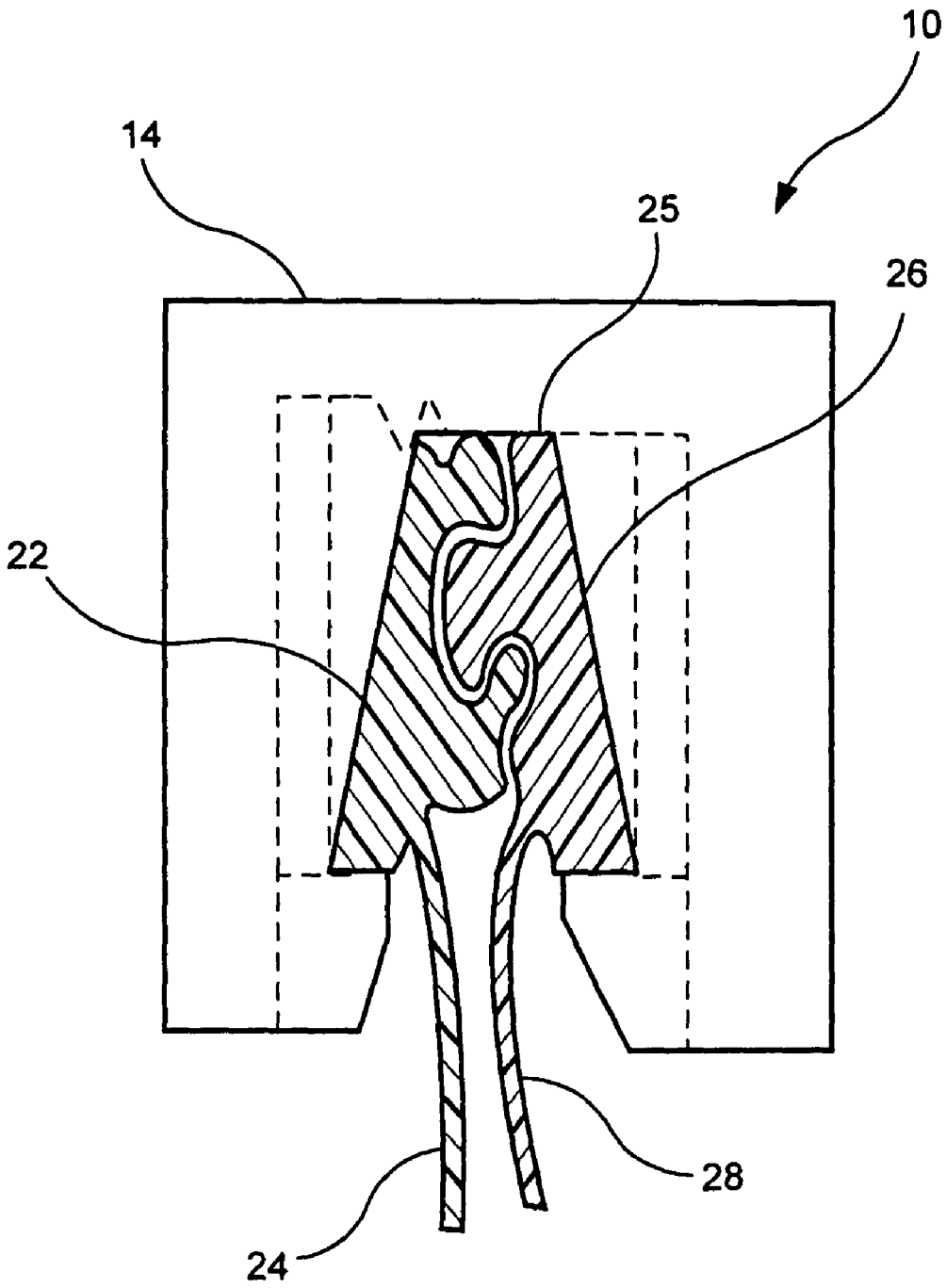
FIG. 3 is an end view of the zipper closing end of the slider with the slider shown encompassing a zipper.

FIG. 2 is an end view of the opening end of the slider 10 with the slider shown encompassing a zipper 25 of a type known to those skilled in the art. As shown in the figure, the keeper 15 secures an interlocking member 22 of profile 24 of zipper 25 by preventing the interlocking member 22 from moving toward the mating interlocking member 26 of profile 28. If the interlocking members are formed of a sufficiently stiff material, the interlocking member 22 may include a slight recess to accommodate the keeper. By preventing movement of the interlocking member 22 towards the interlocking member 26, the profiles 24 and 28 always remain partially disengaged at the opening end, thereby reducing the possibility of an unintentional full engagement of the interlocking members within the slider.

Figure 4:
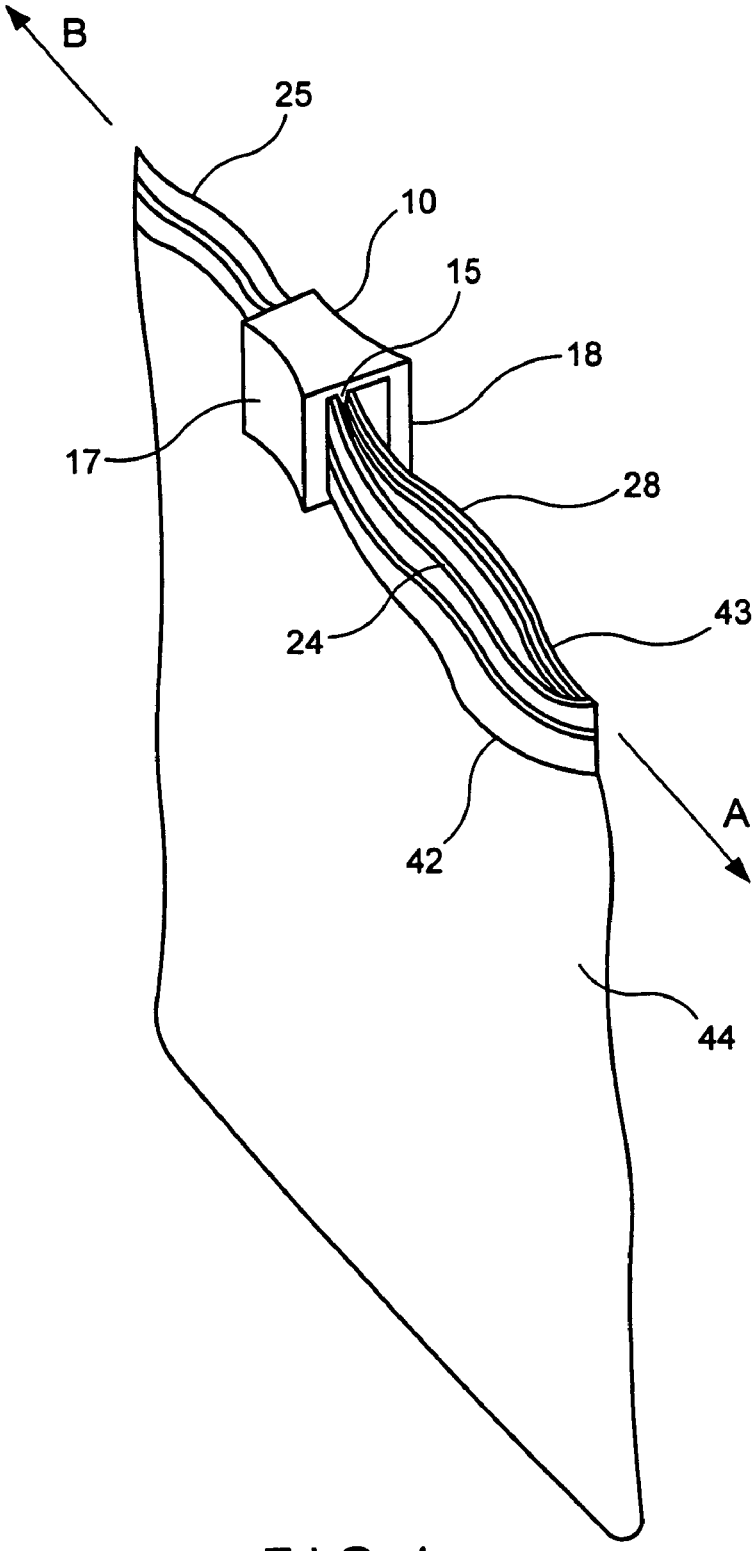
FIG. 4 is a perspective view depicting the slider on a reclosable plastic bag.

FIG. 4 is a perspective view of the slider 10 and zipper 25 as part of a reclosable bag 44. In the figure, the zipper 25 is disposed across the transverse top edges 42 and 43 of the front and rear walls of reclosable bag 44. In use, the straddling slider 10 is slidable along the zipper in a closing direction "A" in which the interlocking members 22 and 26 are forced to be fully engaged by the slider. When the slider 10 is moved in an opening direction "B", the interlocking members are disengaged by pinching the arms 17 and 18 at the zipper opening end 12 of the slider 10.

Figure 5:
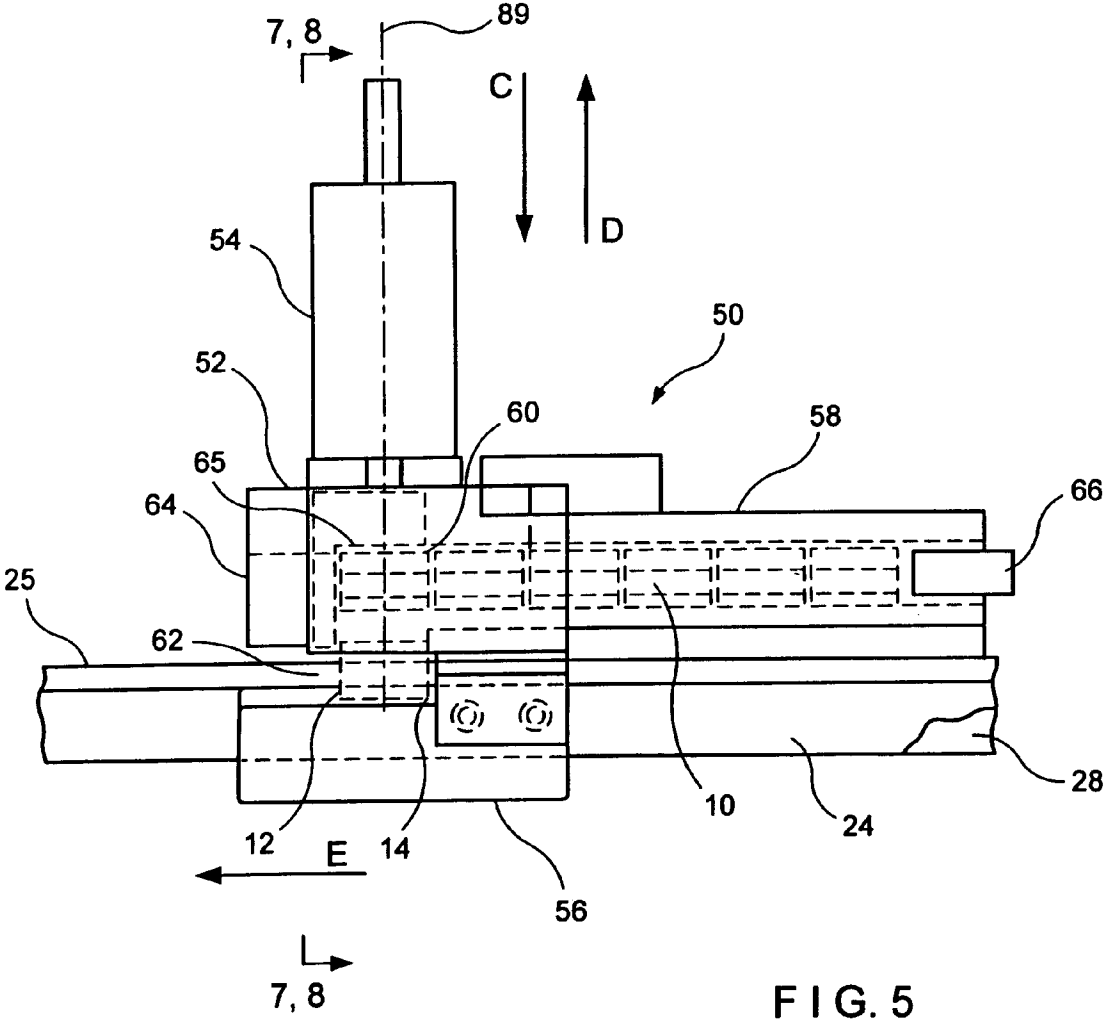
FIG. 5 is a side view depicting a slider insertion apparatus of the present invention using a horizontal slider loading rack.

FIG. 5 is a side view depicting the slider insertion apparatus 50 of the present invention. The slider insertion apparatus generally includes an activator with pusher 52, an insertion cylinder 54, and a zipper guide 56. The specially shaped elements of the activator with pusher 52 and the zipper guide 56 will be further discussed in relation to the detailed figures below. A loading rack 58 may be part of the slider insertion apparatus 50 or may be mechanically attached to the slider insertion apparatus. In FIG. 5, the loading rack 58 is a horizontal magazine-type rack supplying individual sliders 10 at an entry point 60.

During an insertion, in slider insertion area 62, an activating fork 64 of the activator with pusher 52 vertically offsets the interlocking members 22 and 26 of the zipper 25 by moving in direction "C". This activation of the zipper 25 is in close proximity to the zipper opening end 12 of the slider 10 to be inserted. A zipper guide 56 holds the zipper 25 closed at the zipper closing end 14 of the slider 10 to be inserted. Coinciding with the movement of the activating fork 64 in direction "C", a pusher 65 of the activator with pusher 52 inserts the slider 10.

The activator with pusher 52 is driven in direction "C" with a force emitted from the insertion cylinder 54. The insertion cylinder 54 is preferably pneumatically driven for effective slider insertion speed either with a single cylinder or separate cylinders for the activator and pusher.

After insertion of the slider 10 onto the zipper 25, the activator with pusher 52 retracts in direction "D". This retraction movement allows the loading rack 58 to pneumatically deliver another slider 10 to the slider insertion apparatus 50 at the entry point 60. The slider 10 may be delivered pneumatically or a mechanical pawl 66 may also be used on the loading rack 58 for moving the slider 10 to the slider insertion apparatus. The mechanical pawl 66 is typically used if the insertion rate requirements must be in excess of a few per minute.

The zipper guide 56 then guides a next zipper length by the profiles 24 and 28 in direction "E" into the slider insertion apparatus 50. As the zipper 25 enters and advances through the zipper guide 56, the confined opening of the zipper guide will prevent the zipper from opening or rolling from side to side, contributing to a stable insertion of the next slider 10.

Figure 6:
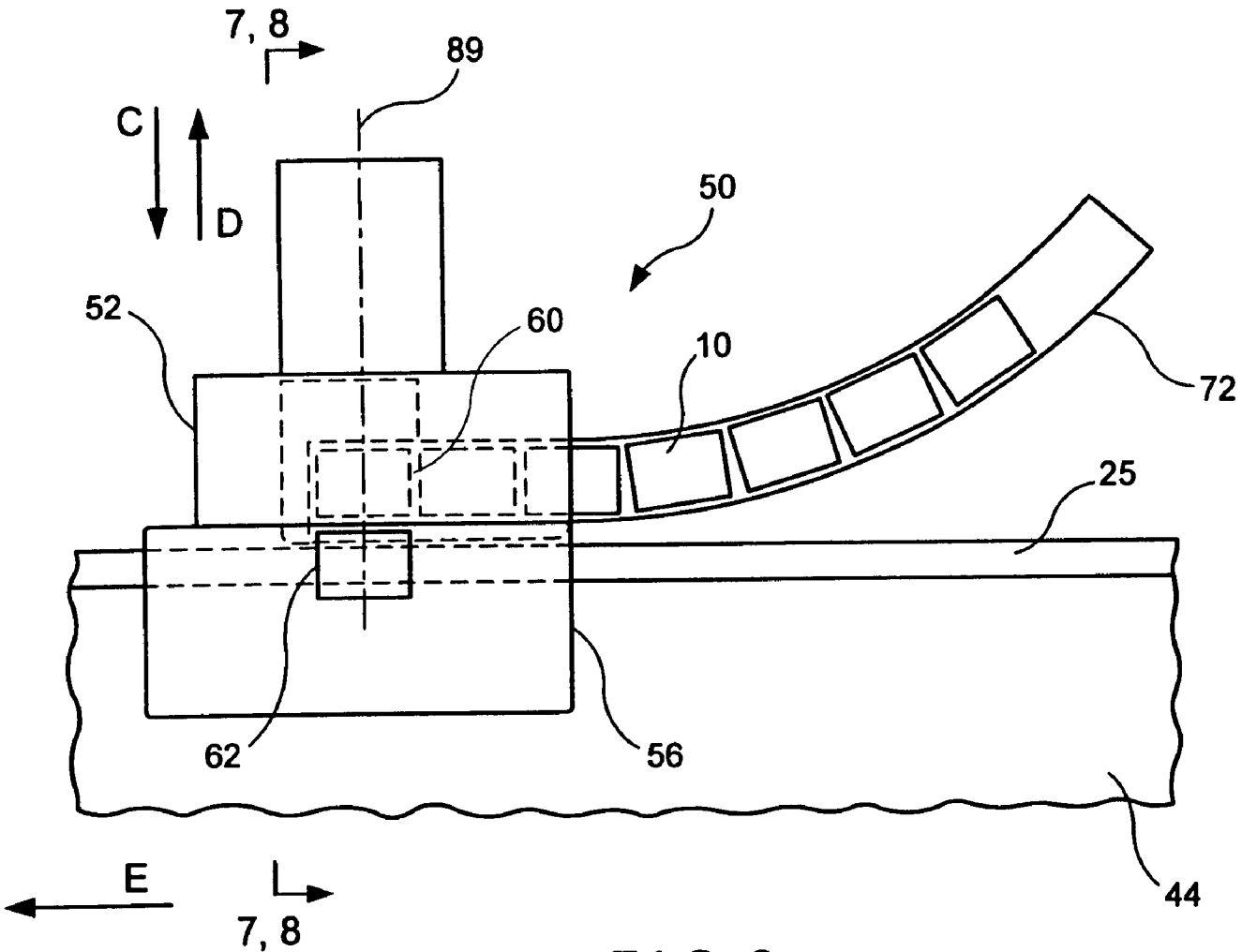
FIG. 6 is a side view depicting the slider insertion apparatus using a curved slider loading rack.

FIG. 6 depicts the slider insertion apparatus 50 of the present invention with a curved loading rack 72. Using the curved loading rack 72 may have advantages over a horizontal loading rack in terms of space consideration, as well as the assistance of gravity in feeding sliders 10 to the slider insertion apparatus 50.

Figure 8:
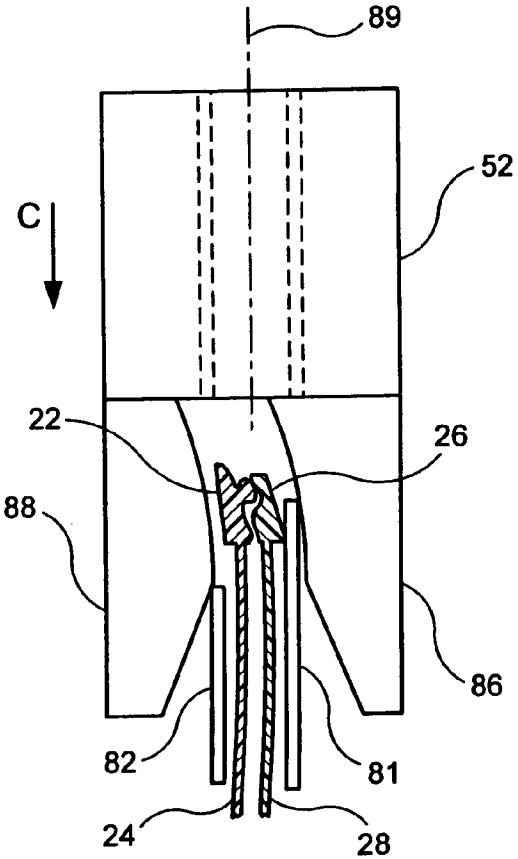
FIG. 8 is a sectional view depicting the activator with pusher taken from reference line 8—8 of FIGS. 5 and 6 and depicting an interlocked zipper activated prior to a slider insertion.
Figure 7:
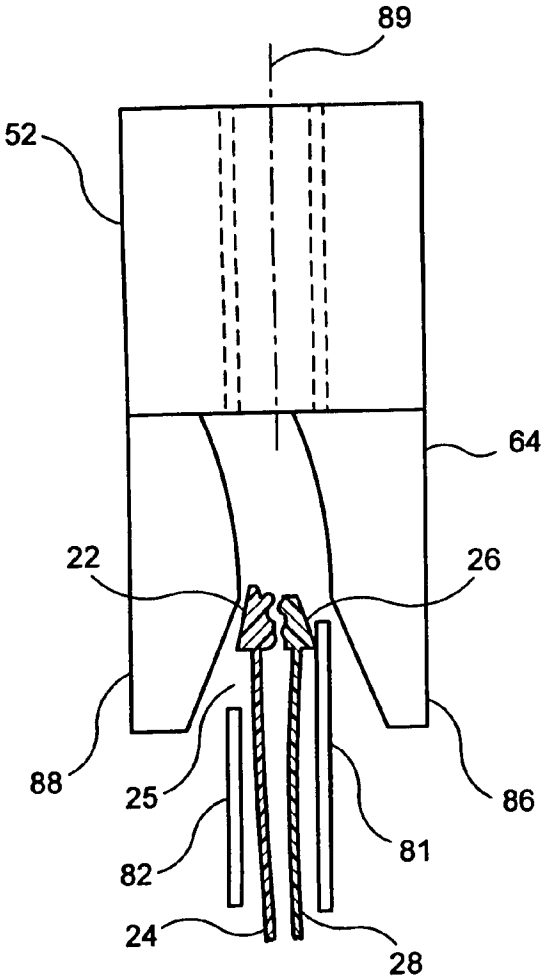
FIG. 7 is a sectional view depicting an activator with pusher taken from reference line 7—7 of FIGS. 5 and 6 and an interlocked zipper positioned prior to activation.

FIG. 7 depicts the interlocking members 22 and 26 in an interlocked or fully engaged position prior to activation. As shown in FIG. 8, the activator with pusher 52 moves in direction "C" to offset the interlocking members 22 and 26 at the zipper opening end 12 of the slider 10 to be inserted. In the offsetting or activating action, the interlocking members are partially disengaged but are not separated. When the interlocking members 22 and 26 are offset in relation to each other, the keeper 15 can properly secure the interlocking member 22. See FIG. 2.

Figure 9:
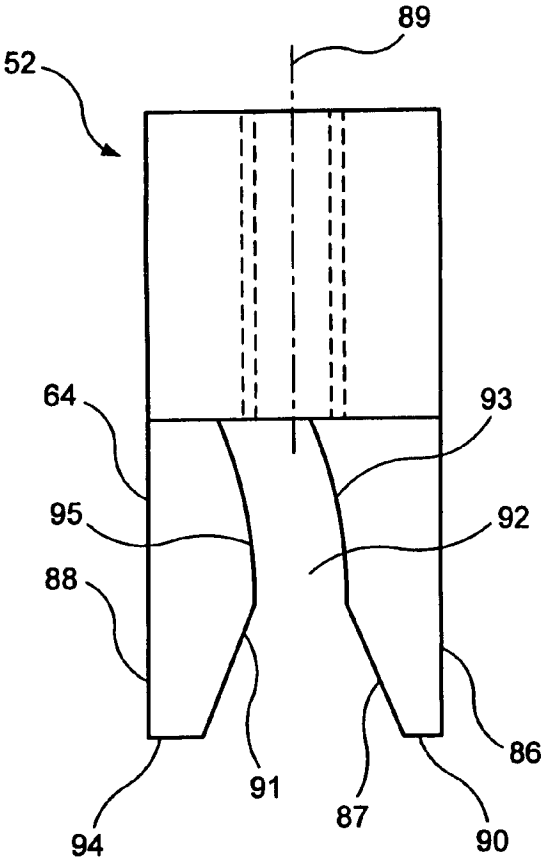
FIG. 9 is a sectional view of the activator with pusher of the present invention.

FIG. 9 is a sectional view of the activator with pusher 52. As shown in the figure, the activator with pusher 52 includes the activating fork 64 formed by the fins 86 and 88. From a lower end 90, the inner surfaces of the lower portions 87, 91 of the fins 86 and 88 chamfer towards a vertical plane 89 between the fins. The chamfer of the fin facilitates movement of the zipper guide 56 within the slider insertion apparatus 50. The upper portion 93 of fin 86 further tapers toward the vertical plane 89 and the upper portion 95 of the opposite fin 88 tapers parallel to the upper portion 93 of the fin 86, so that a clearance 92 is formed. The shape of clearance 92 positions the interlocking members 22 and 26 of the zipper for proper placement within the slider 10, particularly allowing the interlocking member 22 to be secured by the keeper 15 (as shown in FIG. 2).

Figure 10:
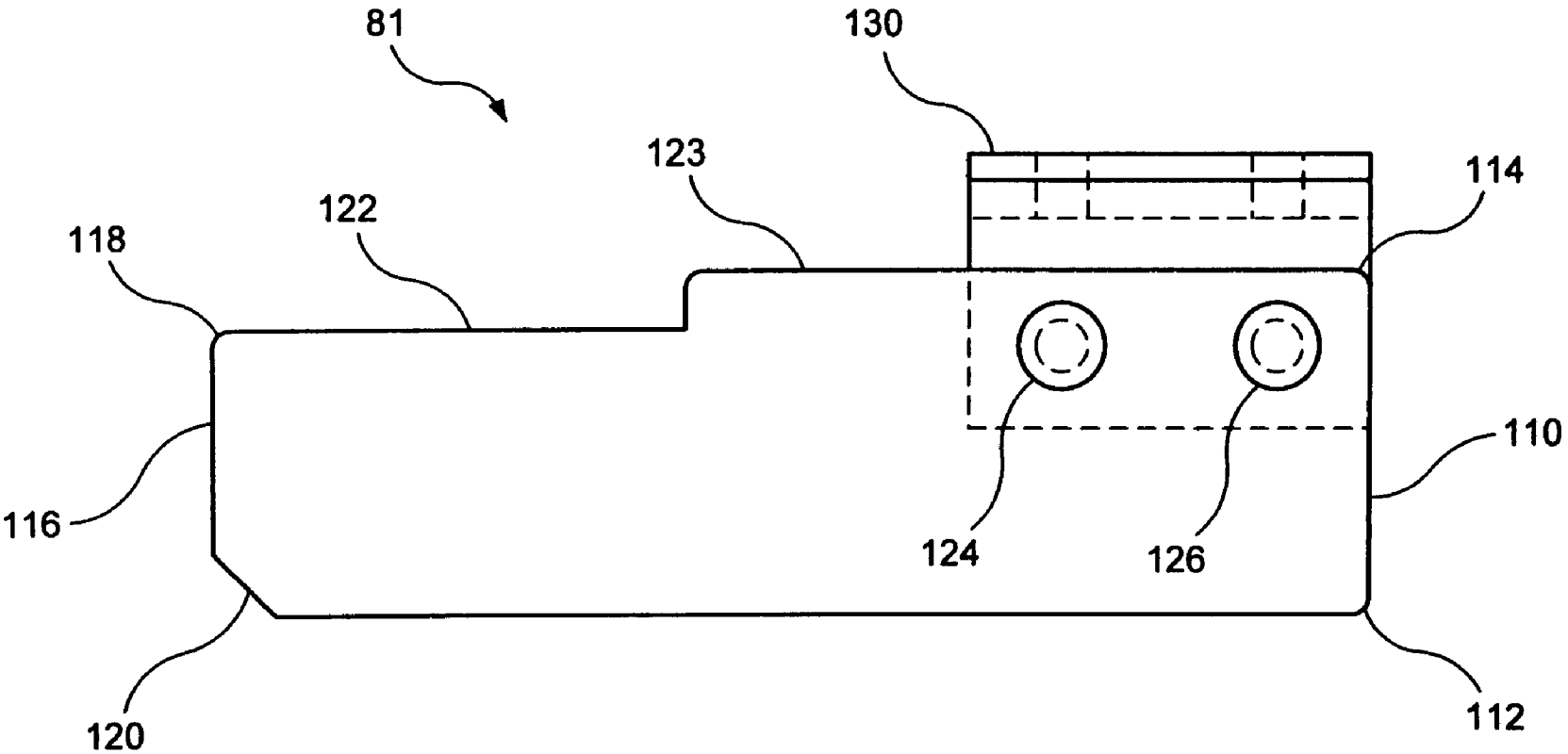
FIG. 10 is a side view of the male guide plate of the zipper guide of the present invention.
Figure 11:
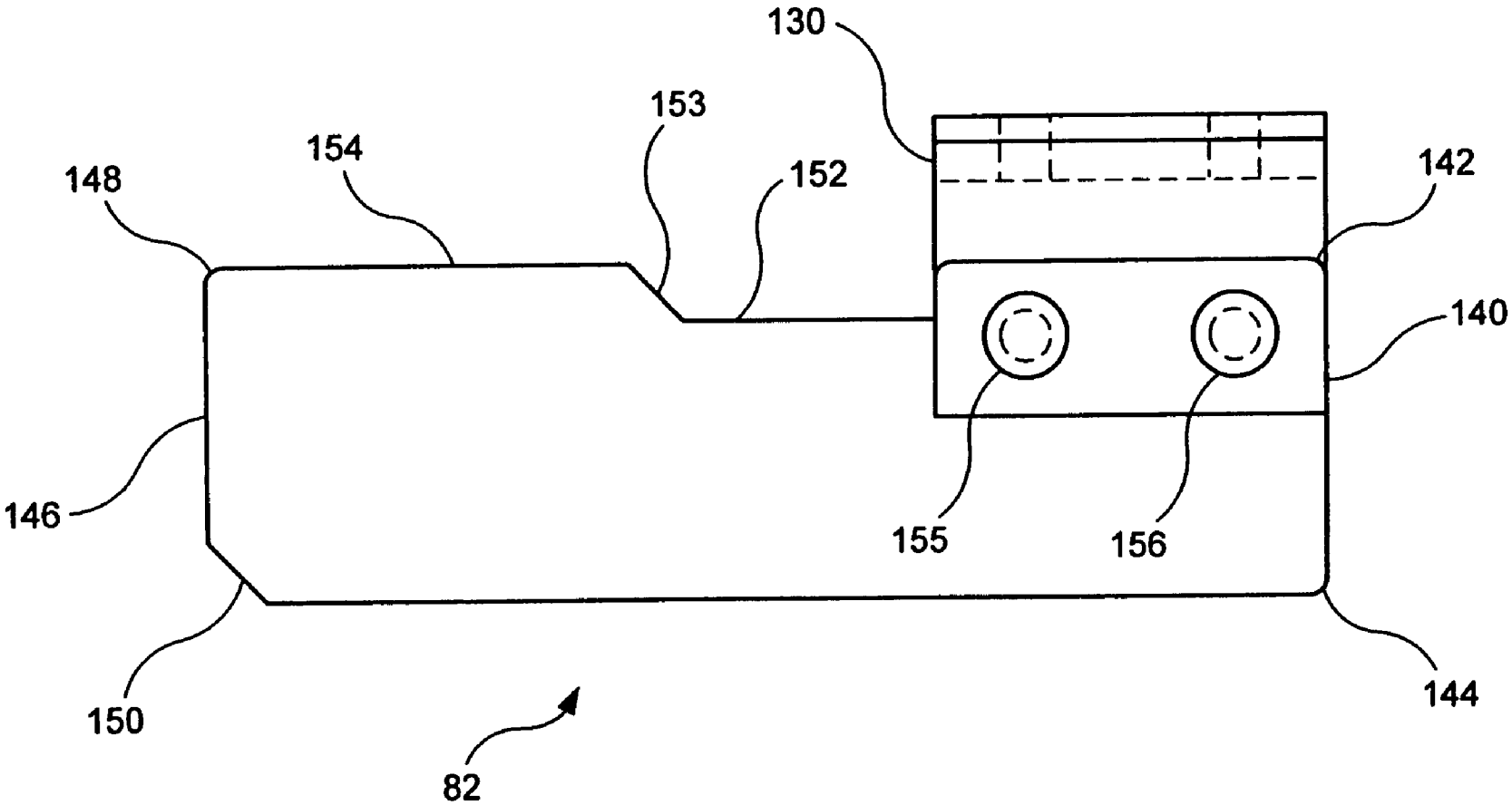
FIG. 11 is a side view of the female guide plate of the zipper guide.

Shown respectively in FIGS. 10 and 11, the male guide plate 81 and the female guide plate 82 comprise the guiding portion of the zipper guide 56. At a zipper entering end 110 of the male guide plate 81 of FIG. 10, each of the corners 112 and 114 is shaped with a radius to prevent snagging or slitting of the profiles 24 and 28 entering the slider insertion apparatus 50. At a zipper exiting end 116, a top corner 118 has a radius and a bottom corner 120 is chamfered. Similar to the formed radii at the zipper entering end 110, the shapes of the corners 118 and 120 minimize slitting or snagging of the profiles 24 and 28 during movement of the reclosable bag 44 within the zipper guide 56. If space permits, the length of the zipper guide 56 can be extended at the exiting end 116 of the male guide plate 81. See FIG. 13 for a detailed view of an extended male guide plate.

In FIG. 10, the male guide plate 81 forms a notch 122 away from the zipper exiting end 116 in order to accommodate the slider 10 after slider insertion. Toward the zipper entering end 110, the male guide plate 100 extends from the notch 122 for a protrusion 123. The protrusion 123 functions to maintain the stability of the zipper 25 and to offset the interlocking members 22 and 26 when the activator with pusher 52 activates the zipper 25. Two apertures 124 and 126 are provided to accommodate fasteners (not shown) which mechanically attach the male guide plate 81 to an attachment piece 130.

The female guide plate 82 of the zipper guide 56 is shown in FIG. 11. In the figure, the female guide plate 82 has a zipper entering end 140, with each corner 142 and 144 of the zipper entering end shaped with a radius. The radial shape of the corners 142 and 144 prevents snagging and slitting of the profiles 24 and 28 as the profiles enter the slider insertion apparatus 50. At a zipper exiting end 146, a top corner 148 has a radius and a chamfered bottom corner 150. Similar to the formed radii at the zipper entering end 140, the shape of the corners 148 and 150 minimizes slitting or snagging of the profiles 24 and 28 during movement of the reclosable bag 44 within the slider insertion apparatus 50. Also similar to the extension of the male guide plate 81, the length of the zipper guide 56 can be extended at the zipper exiting end 146. See FIG. 13 for a detailed view of an extended female guide plate.

In FIG. 11, the female guide plate 82 is formed with a notch 152 to accommodate the activation fork 64 during zipper activation. A slope section 153 allows a zipper 25 with a straddling slider 10 to move up and away from the notch to protrusion 154 as the zipper is pulled away from the slider insertion apparatus 50. Two apertures 155 and 156 are provided and sized to accommodate fasteners (not shown) which mechanically attach the female guide plate 82 to the attachment piece 130.

Figure 12:
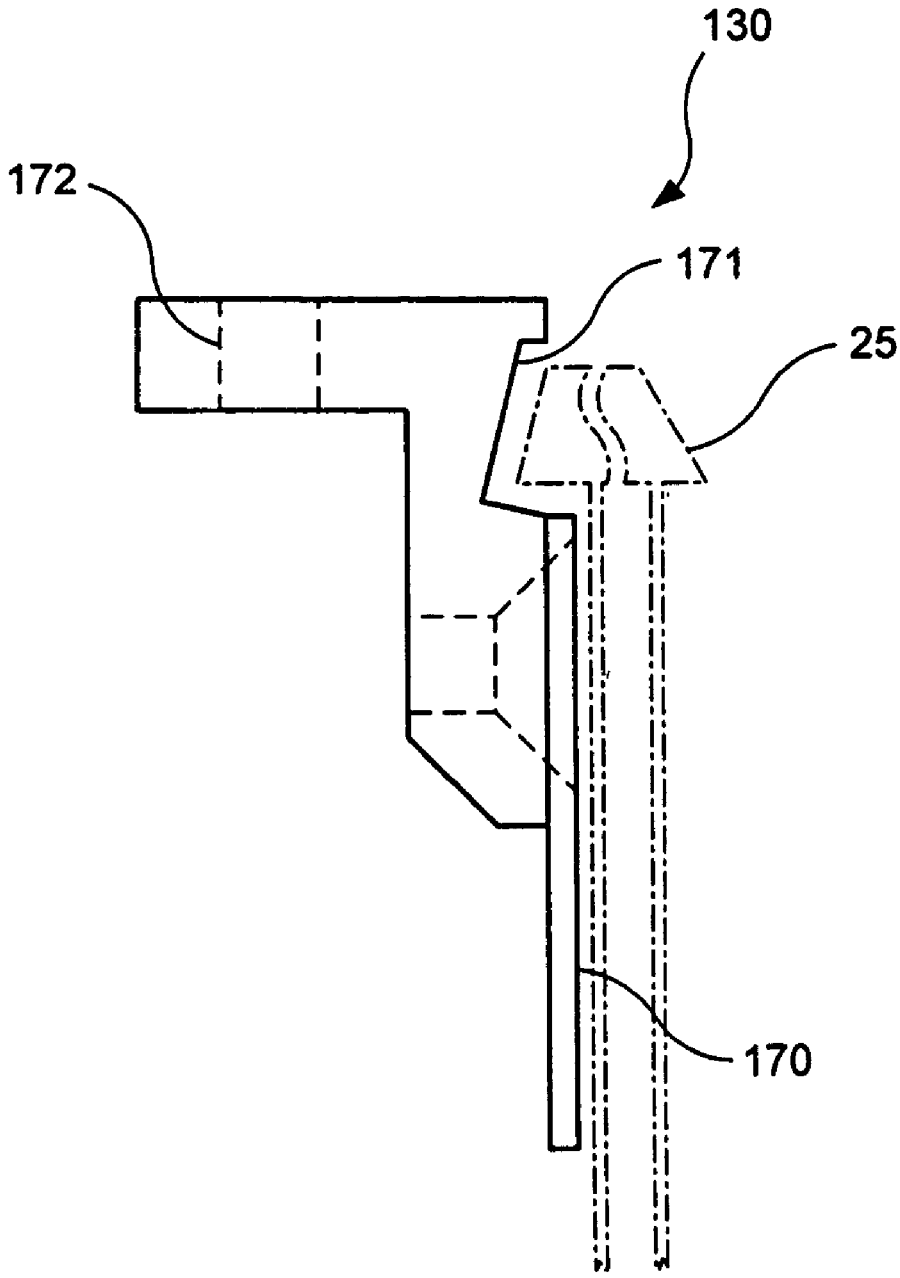
FIG. 12 is an end view of the attachment piece of the zipper guide.

FIG. 12 is a detailed view of the attachment piece 130 used for the male guide plate 81. Another attachment piece 130 is provided for attachment of the female guide plate 82 in the same fashion.

As shown in FIG. 12; a faceplate 170 is provided for attachment of the male plate 81. The attachment piece 130 is formed as an angle bracket to strongly secure to the slider insertion apparatus 50 while allowing flexibility of the zipper guide 56. The attachment piece 130 includes a notch 171 sized to allow passage of the engaged zipper 25 (shown in phantom lines for purposes of illustration) to the slider insertion area 62. Apertures 172 are provided for securing fasteners (not shown) which attach the attachment piece 130 to the slider insertion apparatus 50.

Figure 13:
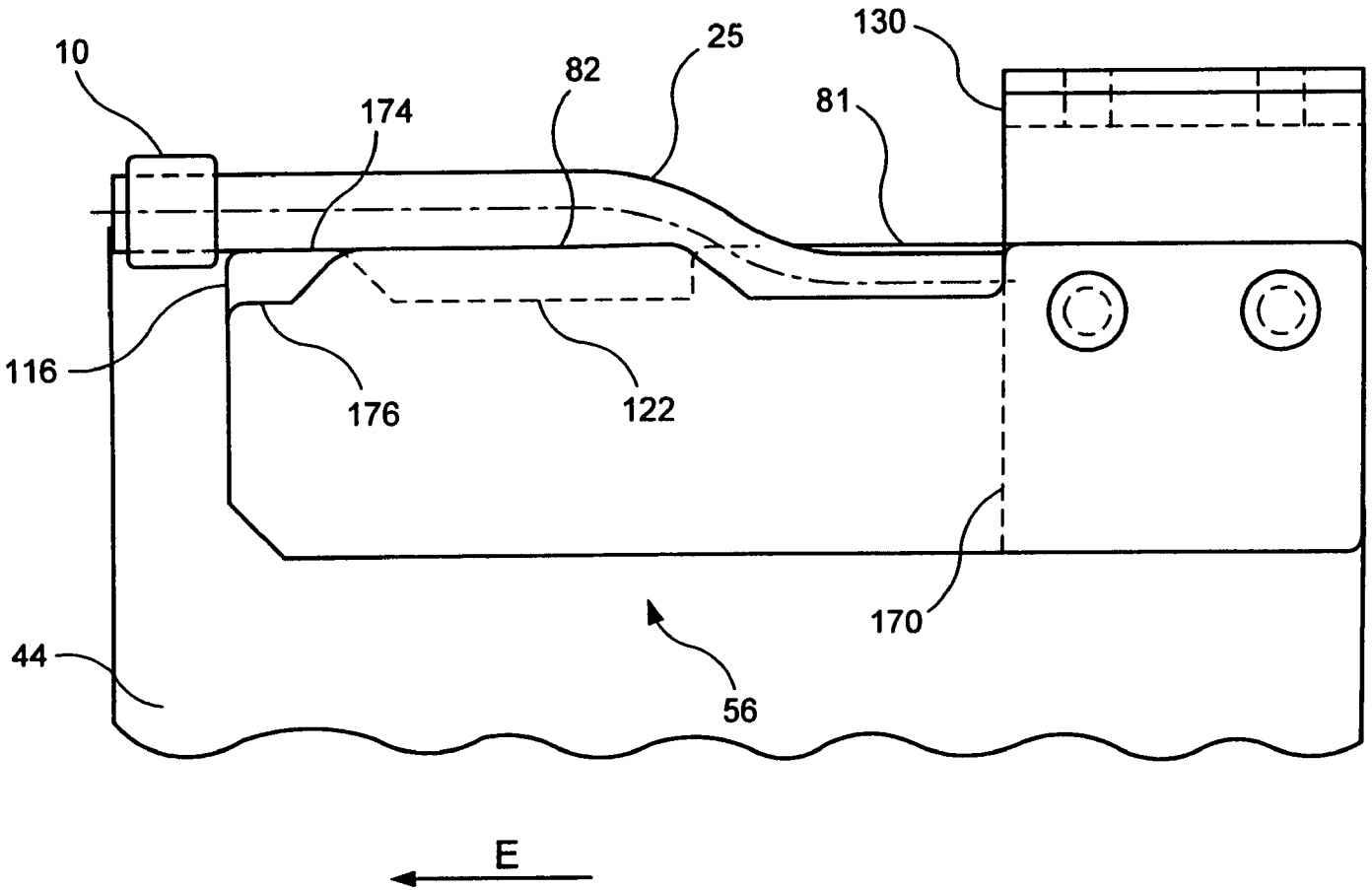
FIG. 13 is a side view of the zipper guide with an extended male guide plate, an extended female guide plate and the attachment pieces shown assembled.

FIG. 13 depicts an extended male guide plate 81, an extended female guide plate 82 and the attachment pieces 130 assembled to form the zipper guide 56. The extension of the male guide plate 81 provides for another protrusion 174 tapering away from the notch 122 and toward the zipper exiting end 116. Increasing the length of the male guide plate 81 provides added support for the profiles 24 and 28 and further straightens any misalignment which may occur during slider insertion.

The extension of the female guide plate 82 includes another notch 176 tapering down from the protrusion 154 and opposing the protrusion 174 of the male guide plate 81. The notch 176 minimizes interference with the zipper 25 and allows the slider to transition away smoothly without fluctuations when the zipper 25 is pulled through the slider insertion apparatus 50 in direction "E".

The male guide plate 81 and the female guide plate 82 assemble to their respective attachment pieces 130 with fasteners through the apertures of each plate and piece. By attaching the guide plates 81 and 82 to the slider insertion apparatus 50 by way of the attachment pieces 130, the guide plates can be rigidly mounted and can resist misalignment forces produced during slider insertion.

Figure 14A:
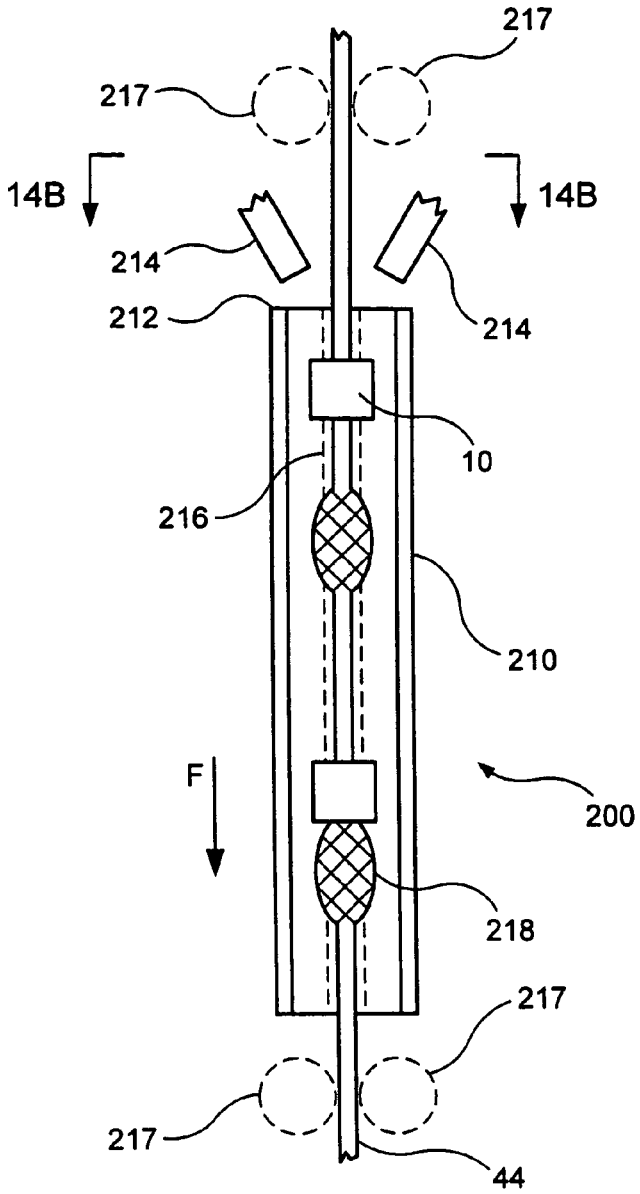
FIG. 14A is a side view of the pneumatic positioner of the present invention.
Figure 14B:
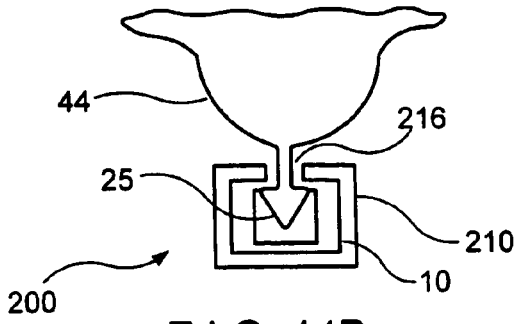
FIG. 14B is a sectional view of the pneumatic positioner taken from reference line 14B—14B of FIG. 14A.

FIGS. 14A and 14B depict a pneumatic positioner 200 that may be used in conjunction with a vertical form, fill and seal (VFFS) bag making machine or an alternative automated process for producing reclosable bags. The pneumatic positioner 200 would typically be used after the slider 10 has been inserted onto the zipper 25 of the reclosable bag 44.

As shown in FIG. 14A, the reclosable bag 44 enters a channel-shaped guide 210. At the upper end 212 of the guide 210, a pneumatic source 214 blows pressurized air into the guide. With a clearance 216 sized to snugly accommodate the reclosable bag 44, the force of the pressurized air focuses on pushing against the slider 10, thereby assisting belt drives 217 of the VFFS machine when moving the reclosable bag 44 through the guide 210 in direction "F".

Alternatively, if the force of the pressurized air exceeds the drag force of the slider 10 on the zipper 25, the relative motion between the slider and the zipper will move the slider 10 against the end stop 218, thereby placing the zipper in a fully opened or a fully closed position. If pressurized air is still applied, the force of the pressurized air acts against the slider 10 on the end stop 218, thereby moving the reclosable bag 44 down the guide 210 in direction "F". On horizontal bag-making machines or other bag-making machines known to those skilled in the art, the pneumatic positioner 200 could be used for opening or closing the zipper 25.

The foregoing description of the preferred embodiments of the invention has been presented for purposes of illustration and description. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

We claim:

1. An apparatus for inserting a slider onto a length of zipper of the type comprising a first profile having a first interlocking member and a second profile having a second interlocking member mated with said first interlocking member, said apparatus comprising:

a guide for receiving a length of said zipper;

a pusher movable in a direction generally transverse to said length of zipper and including a forked member with protruding fins, said protruding fins engaging a portion of said zipper to offset said first interlocking member relative to said second interlocking member in the direction of movement of said pusher;

means for guiding a slider over said offset interlocking members of said zipper and urging said slider onto said offset interlocking members; and wherein said protruding fins border a curved clearance wherein said first interlocking member and said second interlocking member are received within said clearance.

2. The slider insertion apparatus in accordance with claim 1 further including a slider loading rack which delivers a continuous supply of sliders to the guiding means.

3. The slider insertion apparatus in accordance with claim 2 wherein the slider loading rack further includes a mechanical pawl which urges the sliders to move in the slider loading rack to a mounting location.

4. The slider insertion apparatus in accordance with claim 2 wherein the slider loading rack further includes a source of pressurized air fluidly connected to the slider loading rack which urges the sliders to move in the slider loading rack to a mounting location in response to a force of pressurized air from the air source.

5. An apparatus for inserting a slider onto a length of zipper of the type comprising a first profile having a first interlocking member and a second profile having a second interlocking member mated with said first interlocking member, said apparatus comprising:

a guide for receiving a length of said zipper;

a pusher movable in a direction generally transverse to said length of zipper and including a forked member for engaging a portion of said zipper to offset said first interlocking member relative to said second interlocking member in the direction of movement of said pusher; and means for guiding a slider over said offset interlocking members of said zipper and urging said slider onto said offset interlocking members;

wherein said forked member includes protruding fins bordering a curved clearance wherein said first interlocking member and said second interlocking member are received within said clearance;

further including a slider loading rack which delivers a continuous supply of sliders to the guiding means, said slider loading rack including a mechanical pawl which urges the sliders to move in the slider loading rack to a mounting location;

wherein the zipper guide further includes a male guide plate and opposing female guide plate, said guide plates being connected to the slider insertion apparatus by an attachment piece with a portion of the attachment piece shaped to hold said zipper interlocked, said male guide plate including a notch defining said mounting location for accommodating a slider within said zipper guide, said notch being positioned along a longitudinal edge of the male plate facing the pusher.

6. The slider insertion apparatus in accordance with claim 5 wherein a first end of the notch of the male guide plate continues from a first zipper exiting end to a first protrusion along the longitudinal edge, said first protrusion extending to the pusher to stabilize the first and second interlocking members during movement of said pusher.

7. The slider insertion apparatus in accordance with claim 6 wherein said female guide plate includes a first notch opposite the first protrusion of the male guide plate and providing a clearance for the movement of the pusher.

8. The slider insertion apparatus in accordance with claim 7 wherein said female guide plate further includes a protrusion opposite the notch of the male guide plate, said protrusion of the female guide plate guiding the length of zipper after slider insertion from said mounting location to an area outside of said male and female guide plates.

9. The slider insertion apparatus in accordance with claim 8 wherein the first zipper exiting end of the male guide plate includes a corner chamfered away from a perpendicular axis of the first zipper exiting end with a radius formed at each remaining corner of the male guide plate and wherein the female guide plate includes a second zipper exiting end with a corner chamfered away from a perpendicular axis of the second zipper exiting end with a radius formed at each remaining corner of the female guide plate such that the radial corners of said male and female guide plates prevent snagging of the length of zipper received by said zipper guide.

10. The slider insertion apparatus in accordance with claim 9 wherein the male guide plate further includes a second protrusion continuing from the first end of the notch and collinear with the first protrusion of the male guide, said second protrusion providing further alignment of the length of zipper after slider insertion.

11. The slider insertion apparatus in accordance with claim 10 wherein the female guide plate further includes a second notch opposite the second protrusion of the male guide plate.

* * * * *